US011167778B2

(12) United States Patent
Debost et al.

(10) Patent No.: US 11,167,778 B2
(45) Date of Patent: Nov. 9, 2021

(54) COLLISION ENERGY ABSORBING SYSTEM CONCENTRATED AROUND THE VHS POWER CAR AND FIRST VEHICLE

(71) Applicant: SpeedInnov, Paris (FR)

(72) Inventors: Pierre Debost, Genevilliers (FR); Patrick Sicot, Reichshoffen (FR)

(73) Assignee: SPEEDINNOV, Paris (FR)

( * ) Notice: Subject to any disclaimer, the term of this patent is extended or adjusted under 35 U.S.C. 154(b) by 321 days.

(21) Appl. No.: 16/127,355

(22) Filed: Sep. 11, 2018

(65) Prior Publication Data

US 2019/0077420 A1 Mar. 14, 2019

(30) Foreign Application Priority Data

Sep. 13, 2017 (EP) ..... 17306181

(51) Int. Cl.

| | |
|---|---|
| ***B61D 15/06*** | (2006.01) |
| ***B61G 11/16*** | (2006.01) |
| *B61C 17/04* | (2006.01) |

(52) U.S. Cl.

CPC ..... *B61D 15/06* (2013.01); *B61G 11/16* (2013.01); *B61C 17/04* (2013.01)

(58) Field of Classification Search

CPC ..... B61D 15/00; B61D 15/06; B61G 11/00; B61G 11/02; B61G 11/08; B61G 11/12; B61G 11/14; B61G 11/16

See application file for complete search history.

(56) References Cited

U.S. PATENT DOCUMENTS

| | | | | |
|---|---|---|---|---|
| 3,307,718 | A * | 3/1967 | Sjostrom | B61D 11/00 414/339 |
| 6,561,105 | B2 * | 5/2003 | Godin | B61C 17/04 105/396 |
| 8,141,497 | B2 * | 3/2012 | Kwon | B61D 15/06 105/392.5 |
| 8,839,722 | B2 * | 9/2014 | Prockat | B61D 17/06 105/392.5 |
| 9,205,847 | B2 * | 12/2015 | Koudolo | B61D 15/06 |
| 2004/0040463 | A1 * | 3/2004 | Yamamoto | B61F 1/10 105/396 |

FOREIGN PATENT DOCUMENTS

| | | |
|---|---|---|
| EP | 0532442 A1 | 3/1993 |
| EP | 0888946 A1 | 1/1999 |
| EP | 1215098 A1 | 6/2002 |
| EP | 1930226 A1 | 6/2008 |

OTHER PUBLICATIONS

Search Report dated Feb. 27, 2018 during the prosecution of European Patent Application No. EP17306181.3.

* cited by examiner

*Primary Examiner* — Robert J McCarry, Jr.
(74) *Attorney, Agent, or Firm* — Troutman Pepper Hamilton Sanders LLP

(57) ABSTRACT

The invention relates to a railway vehicle, wherein the vehicle having a plurality of cars arranged one behind the other longitudinally, wherein each car has a front end articulated to a rear end of the adjacent car; at least one power unit connected to a first of the cars; and a collision energy absorbing assembly, The collision energy absorbing assembly has a first collision energy absorbing system located at the front of the power unit and a second collision energy absorbing system located at the connection between the power unit and the first car.

15 Claims, 10 Drawing Sheets

COLLISION ENERGY ABSORBING SYSTEM CONCENTRATED AROUND THE VHS POWER CAR AND FIRST VEHICLE

CROSS REFERENCE

This application claims the benefit of European Patent Application EP 17306181.3, filed on Sep. 13, 2017 and hereby incorporated by reference herein.

FIELD OF TECHNOLOGY

The present invention relates to a railway vehicle, of the type having a plurality of cars arranged one behind the other longitudinally. Each car has a front end articulated to a rear end of the preceding car, at least one power unit linked to the first of the cars, and collision energy absorbing assembly.

BACKGROUND

Railway vehicles, in particular high-speed trains, may collide with obstacles on the track (e.g. another railway vehicle, a motor vehicle, etc.). In order to reduce the impact of the shock and to preserve the integrity of the driver and passengers optimally, it is known from the prior art to equip railway vehicles with one or more energy absorbing systems in order to convert all or part of the kinetic energy of the shock into mechanical deformation energy. Thus, it is, for example, known to strengthen the front of the power unit by honeycomb structures which form an energy absorbing shield in the event of a shock. EP 1 930 226 A1 and EP 0 888 946 A1 describe a railway vehicle of the aforementioned type.

However, in the event of a violent impact, even if all the collision kinetic energy is absorbed by one or more energy absorbing devices, the deceleration of the railway vehicle may be violent and may cause serious injuries to the driver and passengers.

Thus, normative texts, for example the European standard EN 15227, list all the requirements in terms of passive safety against collisions with which a railway vehicle carrying passengers must comply. In particular, it lays down the maximum permissible deceleration level for a railway vehicle carrying passengers.

The invention aims to provide an articulated railway vehicle that improves passive safety in the event of collisions.

SUMMARY

To this end, the purpose of the invention is to propose an articulated railway vehicle of the aforementioned type, characterized in that the collision energy absorbing assembly comprises a first collision energy absorbing system located at the center of the vehicle in front of the power unit, and a second collision energy absorbing system located at the link between the power unit and the first car.

Thus, the railway vehicle according to the invention comprises a collision energy absorbing assembly that is adapted to articulated railway vehicles, in particular that the energy absorbing devices that compose it are concentrated at the front of the vehicle at the power unit and the connection, i.e. the connection between the power unit and the first car. The design of articulated railway vehicles imposes a particular difficulty with respect to the manner of arranging the collision energy absorbing devices. In fact, the structure of such railway vehicles and, in particular, the articulated links complicate the installation of energy absorbing devices at the junction between two adjacent cars.

According to particular embodiments, the railway vehicle according to the invention comprises one or more of the following characteristics:

- the vehicle further comprises a plurality of bogies, wherein the front and rear ends of two adjacent cars are carried by one of the bogies;
- the first collision absorbing systems and the second collision energy absorbing system are designed to absorb all the energy of a collision as defined by the European standard EN 15227;
- no collision energy absorbing system is located between two adjacent cars;
- the first absorbing system comprises a plurality of deformation modules that are designed to deform in the longitudinal direction;
- at least one of the deformation modules is removable;
- the first absorbing system comprises an automatic energy absorbing coupling comprising an irreversible absorbing and guide system for the coupling, in particular a deformation tube;
- the power unit comprises a chassis, a driver's cab and a protective shield fixed to the cab, wherein the first absorbing system comprises two fusible deformation modules fixed to a front end of the chassis of the power unit connected by a crossmember, two lower deformation modules fixed to the crossmember and two upper deformation modules fixed to the protective shield;
- the second absorbing system comprises two pairs of buffers attached to a rear end of a chassis of the power unit and to a front end of the first car;
- each buffer comprises a first reversible deformation energy absorbing device and a second non-reversible deformation energy absorbing device;
- the power unit is connected to the first car by a drawbar, while the second energy absorbing system comprises a first reversible deformation energy absorbing device installed in the drawbar, a second non-reversible energy absorbing device installed in the drawbar, and side absorbers on both sides of the drawbar.

BRIEF DESCRIPTION OF THE DRAWINGS

The invention will be better understood upon reading the description which follows, given solely by way of example, and with reference to the drawings, wherein.

DETAILED DESCRIPTION

In the description, the terms "upper" and "lower" are defined with respect to a direction of elevation of a railway vehicle when it is arranged on rails, i.e. substantially vertical. The longitudinal direction is defined by the driving direction of the railway vehicle.

Figure 1:
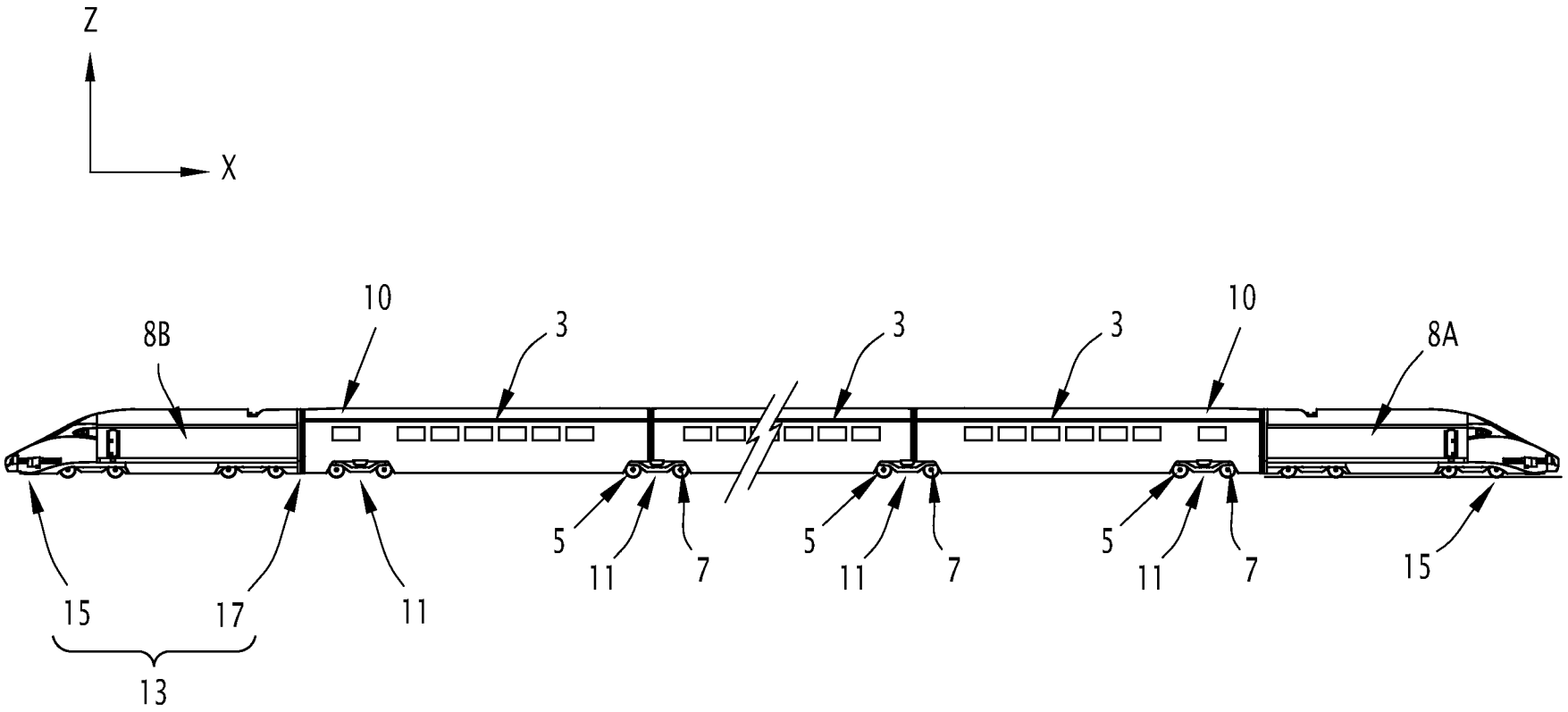
FIG. 1 shows a longitudinal representation of the articulated railway vehicle according to the invention.

FIG. 1 shows schematically an articulated railway vehicle 1 according to the invention. The railway vehicle 1 comprises a plurality of cars 3 arranged longitudinally behind one another in the direction X. Each car 3 has a front end 5 articulated to a rear end 7 of the preceding car 3. The cars 3 are, for example, designed to carry passengers.

The railway vehicle 1 further comprises at least one power unit 8A, 8B linked to the first of the cars 10. Each power unit 8A, 8B comprises a chassis 9, a driver's cab and a protective shield 12 fixed on the cab. In the embodiment shown in FIG. 1, the railway vehicle 1 comprises two power units 8A, 8B placed at the two opposite ends of the railway vehicle 1 in order to facilitate the movement of the railway vehicle 1 in one direction of travel or in the opposite direction.

The railway vehicle 1 also comprises a plurality of bogies 11. Each bogie 11 directly carries the front ends 5 and rear ends 7 of two adjacent cars 3. This type of railway vehicle is said to be "articulated". The bogies 11 are, for example, of the same type as those described in EP 2 883 776 A1 and will not be described in detail here.

Each power unit 8A, 8B of the railway vehicle 1 comprises an collision energy absorbing assembly 13. It should be noted that the collision energy absorbing assemblies 13 of each power unit 8A, 8B are completely identical.

As may be seen in FIG. 1, the collision energy absorbing assembly 13 according to the invention comprises a first collision energy absorbing system located at the front of the power unit 8A, 8B and a second energy absorbing system 17 located at the link between the power unit 8A, 8B and the first car 10. As shown in FIG. 1, no collision energy absorbing system is located between two adjacent cars 3.

Advantageously, the first absorbing system 15 and the second absorbing system 17 are designed to absorb together all the energy of a collision, for example as defined by a normative text concerning passive safety, in particular the European standard EN 152° 27.

In particular, the European standard EN 15227 specifies the European requirements for passive safety for railway vehicles carrying passengers to ensure the protection of passengers in the event of a collision. Thus, in the event of a collision, the mechanical structure of railway vehicles must incorporate systems to limit the deceleration of the vehicle, to protect and guarantee the structural integrity of the occupied spaces, to reduce the risks of overlapping with another railway vehicle, and the risks of derailment, and limit the consequences in the event of collision with an obstacle on the track whose height does not exceed that of the floor of the railway vehicle. According to EN 15227, railway vehicles must fulfill the above requirements by considering four reference collision scenarios: a frontal collision between two identical railway units, a frontal collision with a freight car, a collision of a unit with a large road vehicle at a level crossing and, a collision of a unit with a low obstacle (e.g. an automobile, animal, rock, etc. at a railway crossing).

For example, the standard EN 15227 requires that the average deceleration felt by passengers should not exceed 5 g for collisions with railway vehicles and 7.5 g for collisions with road obstacles. The details of each of the requirements of EN 15227 will not be described here.

Figure 2:
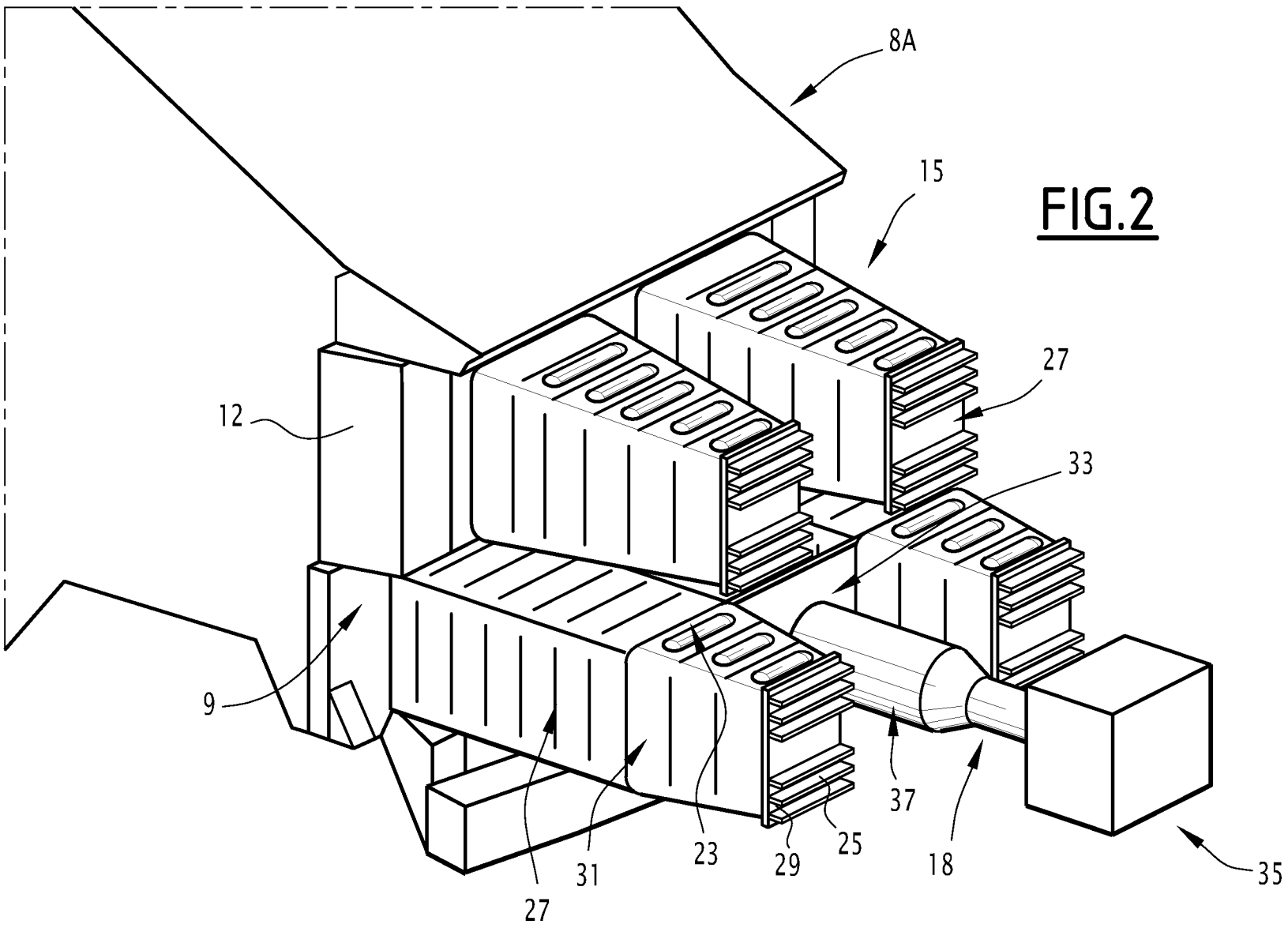
FIGS. 2 and 3 show respectively a side view and a bottom view of the front of the power unit of the railway vehicle of FIG. 1 having the first energy absorbing system.
Figure 3:
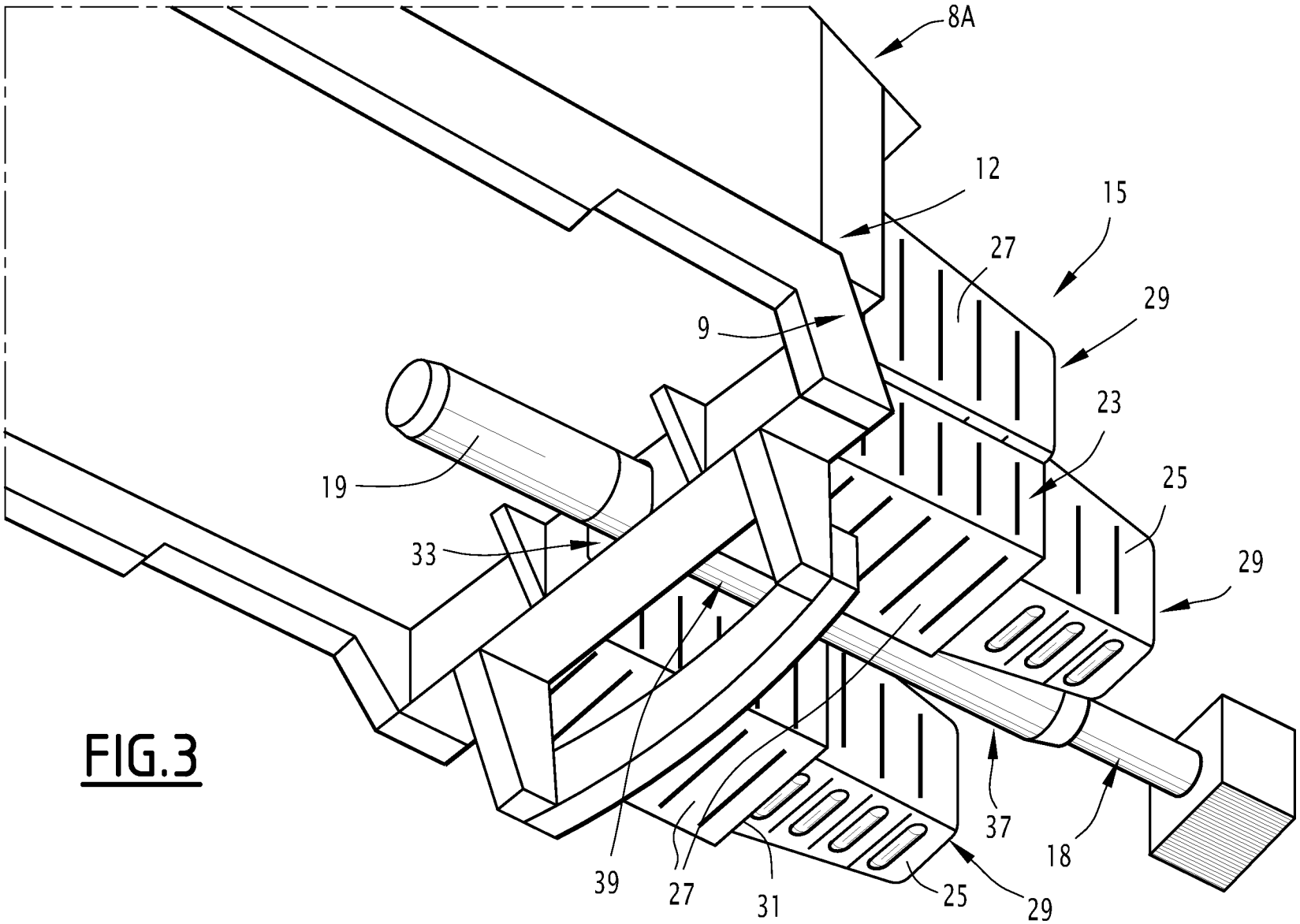

FIGS. 2 and 3 show the first collision energy absorbing system 15. The first energy absorbing system 15 comprises a plurality of deformation modules that are designed to deform in the longitudinal direction, and an automatic energy absorbing coupling 18 comprising, for example, an absorbing system 19 providing both irreversible absorption and guided absorption such as a deformation tube.

As may be seen in FIG. 2, the first energy absorbing system 15 comprises two fusible deformation modules 21 fixed to a front end of the chassis 9 of the power unit 8A, 8B connected by a crossmember 23, two lower deformation modules 25 fixed to the crossmember 23 and two upper deformation modules 27 fixed to the protective shield 12 of the driving cabin of the power unit 8A, 8B.

The lower deformation modules 25 and the upper deformation modules 27 have a substantially truncated pyramid shape gradually widening from their front faces 29 to their rear faces 31. The lower deformation modules 25 and the upper deformation modules 27 are in the form of a set of metal sheets mechanically welded to each other to form a box that is axially compressible through plastic deformation upon a collision at the front face 29 of the deformation module 25, 27.

As shown in FIGS. 2 and 3, the box of each of the deformation modules 25, 27 comprises a plurality of compartments coupled to each other in the longitudinal direction. Thus, upon a collision at the front surface 29 of the module 25, 27, the compartments successively deform plastically and compress each other in the longitudinal direction in order to absorb the collision energy.

The energy absorbing capacity of each lower deformation module 25 is, for example, between 220 kJ and 320 kJ, typically 250 kJ.

The energy absorbing capacity of each upper deformation module 27 is, for example, between 500 kJ and 1000 kJ, typically 700 kJ.

The lower deformation modules 25 are generally referred to as anti-overlapping because, in the event of collision with another railway vehicle, they make it possible to avoid the two vehicles overlapping one another.

The upper deformation modules 27 are generally referred to as absorbing shields. They thus absorb, in particular, the collision energy at the driving position at the front of the power unit 8A, 8B. This helps to protect the driving area in the event of a collision with road obstacles such as trucks.

Advantageously, the lower deformation modules 25 and the upper deformation modules 27 are removable. They are, for example, respectively screwed onto the chassis 9 of the power unit 8A, 8B and on the crossmember 23, and may be replaced if necessary after a collision.

This makes it possible to make the railway vehicle 1 operational more rapidly, particularly in the case of low energy collisions not affecting the fusible deformation modules 21.

The fusible deformation modules 21 are fixed on the chassis 9 of the power unit 8A, 8B for example by welding.

The fusible deformation modules 21 have a substantially parallelepipedal shape and protrude from the chassis 9 of the power unit 8A, 8B in the longitudinal direction. The fusible deformation modules 21 have a compartmental structure, similar to what has been described previously.

The energy absorbing capacity of each fusible deformation module 21 is, for example, between 800 kJ and 1000 kJ, typically 900 kJ.

The fusible deformation modules 21 are in the extension of the lower deformation modules 25.

The automatic coupling 18 is fixed to the front of the power unit 8A, 8B in a projecting manner. It is inserted into an opening 33 made in the crossmember 23, between the two fusible deformation modules 21. The automatic coupling 18 comprises a coupling 35 which provides the automatic coupling function with another railway vehicle, a reversible (or recoverable) energy absorber 37 and a non-reversible energy absorber 39.

The coupling 35 will not be described in detail here and is known per se from the prior art. The coupling 35 comprises a coupling head projecting from the end of the power unit 8A, 8B and providing a mechanical, pneumatic and electrical connection between the power unit and the railway vehicle to which it is coupled.

The reversible energy absorber 37 is in the form, for example, of hydraulic gas capsules to dampen low intensity shocks. The hydraulic gas capsules function as a damping piston. They comprise a first cylinder capable of moving longitudinally within a second hollow cylinder of a diameter greater than that of the first cylinder. The stroke of the first cylinder is slowed down by a fluid (for example oil) and the energy is dissipated, for example in the form of heat.

Typically, the maximum stroke of the first cylinder is between 60 mm and 200 mm.

For example, the energy absorbing capacity of the reversible energy absorber 37 is between 30 and 200 kJ typically 80 kJ.

As seen in FIG. 3, the absorbing system 19 extends longitudinally under the chassis 9 of the power unit 8A, 8B.

The absorbing system 19 comprises a first cylinder which extends longitudinally in a projecting manner. The first cylinder is force-fitted into a second cylinder having a diameter smaller than that of the first cylinder. Thus, in the event of a shock, the first cylinder is extruded and plastically deforms the second cylinder.

The non-reversible energy absorber 39 allows, for example, the absorption of an amount of energy between 500 and 2400 kJ, typically 1200 kJ.

Figure 4:
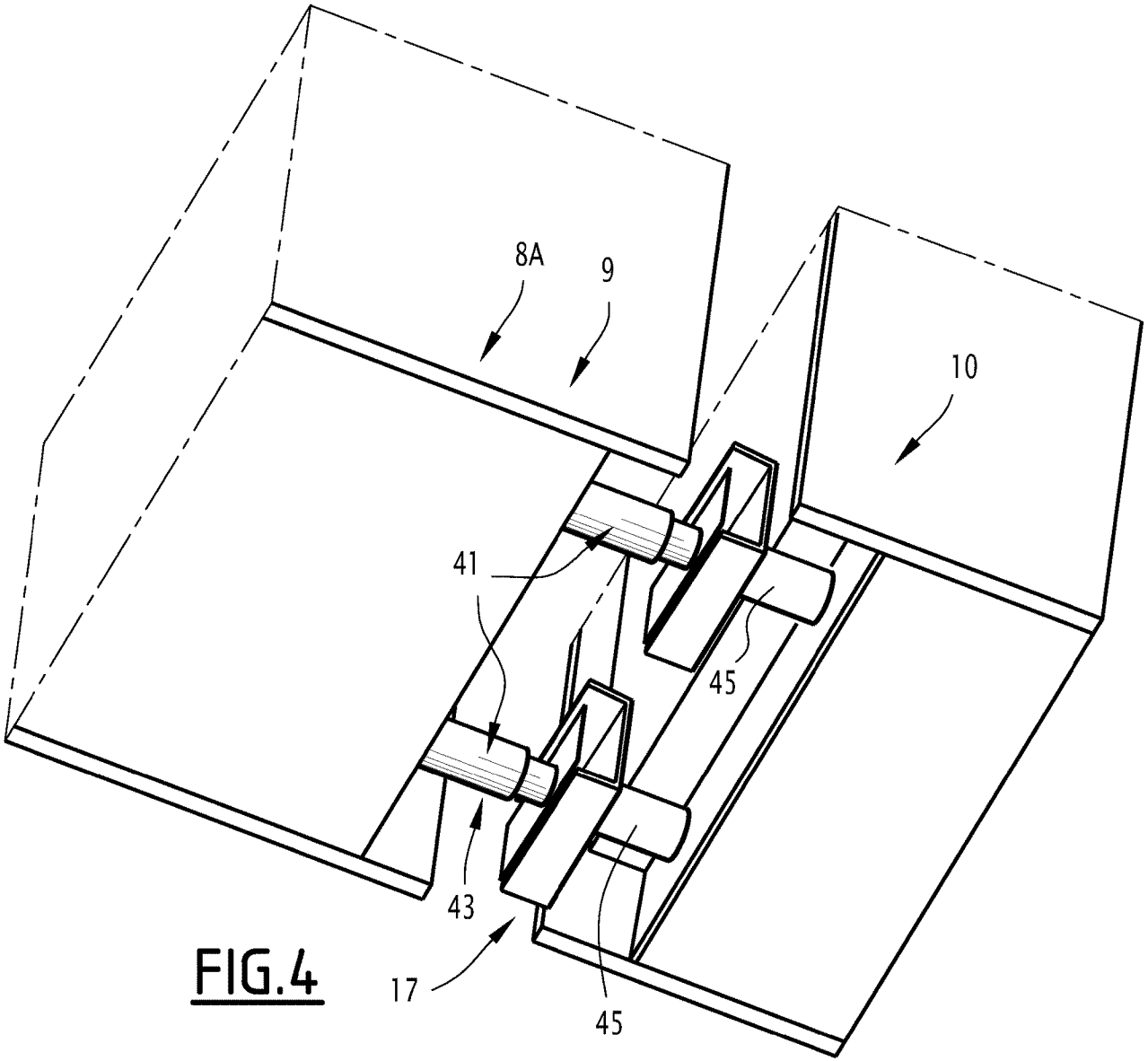
FIG. 4 shows a bottom view of the connection zone between the power unit and the first car of the railway vehicle of FIG. 1 and shows an exemplary embodiment of the second energy absorbing system.
Figure 5:
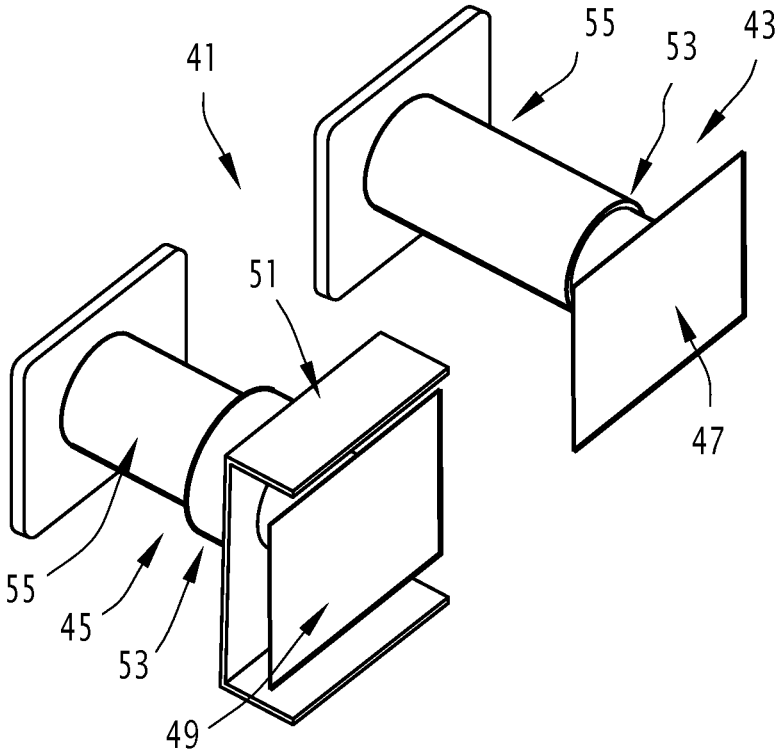
FIG. 5 shows a perspective view of a pair of buffers of the second energy absorbing system.
Figure 6:
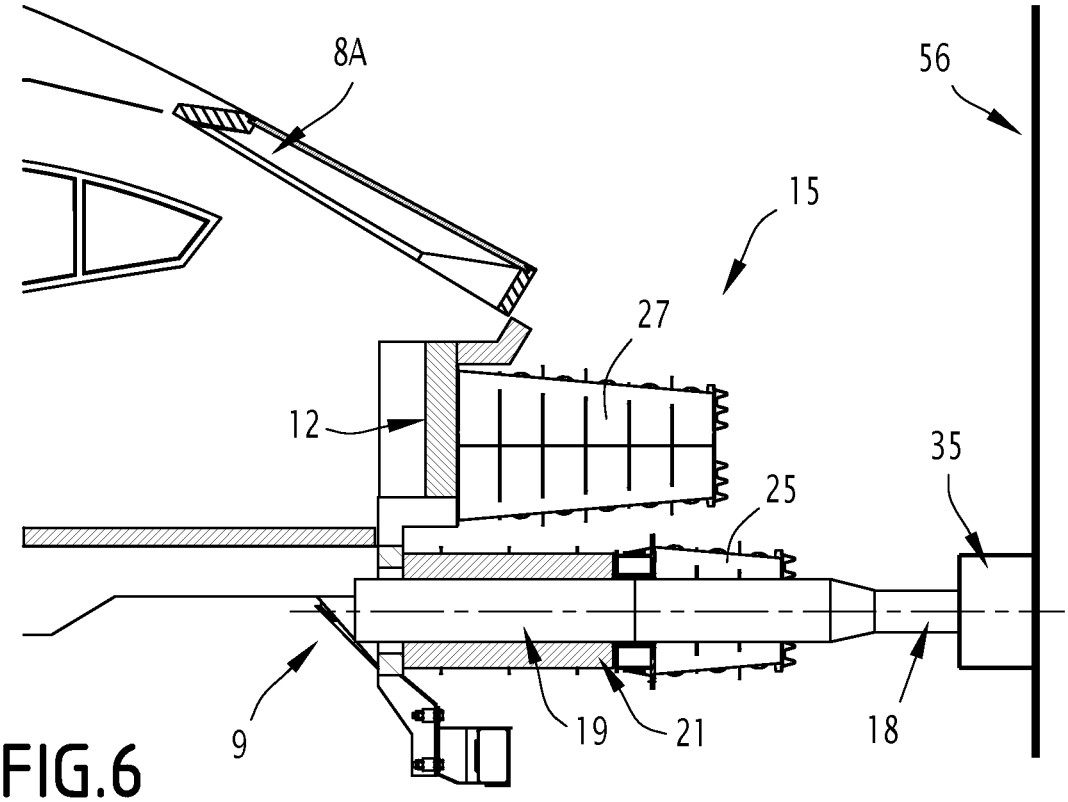
FIGS. 6 to 11 show schematic side views of the front of the power unit showing the behavior of the first energy absorbing system at different stages of absorption of a frontal impact.

FIGS. 4 and 5 show an exemplary embodiment of the second energy absorbing system 17. The second energy absorbing system 17 comprises two pairs of buffers 41 attached to a rear end of a chassis 9 of the power unit 8A, 8B and at a front end of the first car 10.

Each pair of buffers 41 comprises a first buffer 43 attached to the rear end of the power unit 8A, 8B, and a second buffer 45 attached to the front end of the first car 10.

The first buffer 43 has a head 47 projecting from the rear end of the power unit 8A, 8B. The second buffer 45 has a plate 49 projecting from the front end of the first car 10. The second buffer 45 further comprises an anti-overlapping device 51 of the first buffer 43 and second buffer 45. The anti-overlapping device 51 is known from the prior art and is not described in detail here.

In the event of a shock, the head 47 of the first buffer 43 interacts with the plate 49 of the second buffer 45.

Typically, each first buffer 43 and second buffer 45 comprises a first reversible deformation energy absorbing device 53 and a second non-reversible deformation energy absorbing device 55.

The first device 53 is typically a hydraulic gas capsule of the type described above for the coupling 18.

Typically, the maximum stroke of the first device 53 is between 90 mm and 125 mm, typically 110 mm.

The energy absorbing capacity of the first device 53 is, for example, between 30 kJ and 100 kJ, typically 60 kJ.

The second device 55 is typically a device comprising a deformation tube of the type previously described for the coupling 18 or a peeling system of the outer surface of the buffer tube. In the case of a peeling system, blades are arranged in the vicinity of the attachment of the buffer to a car 8A, 10. These blades are arranged circumferentially on the periphery of the outer surface of the buffer tube, and are able to "peel", i.e. to cut the outer surface of the tube longitudinally, in the event of a shock.

The energy absorbing capacity of the second device 55 is, for example, between 200 kJ and 1150 kJ, typically 500 kJ.

Alternatively, in an embodiment that is not shown, the power unit 8A is connected to the first car 10 by a drawbar and the second energy absorbing system 17 comprises, for example, a first reversible deformation energy absorbing device 17 installed in the drawbar, a second non-reversible deformation energy absorbing device installed in the drawbar, and side absorbers on either side of the drawbar.

The operation of the collision energy absorbing assembly 13 of the railway vehicle 1 will now be described with reference to FIGS. 6 to 14 which show the behavior at different stages of the first energy absorbing system 15 and the second energy absorbing system 17 in the event of a frontal collision of the railway vehicle 1.

Of course, this collision scenario is given as an indication and not a limitation since the collision energy absorbing assembly 13 is designed to absorb all the energy of a collision as defined by the European standard EN 15227, as previously described.

Figure 7:
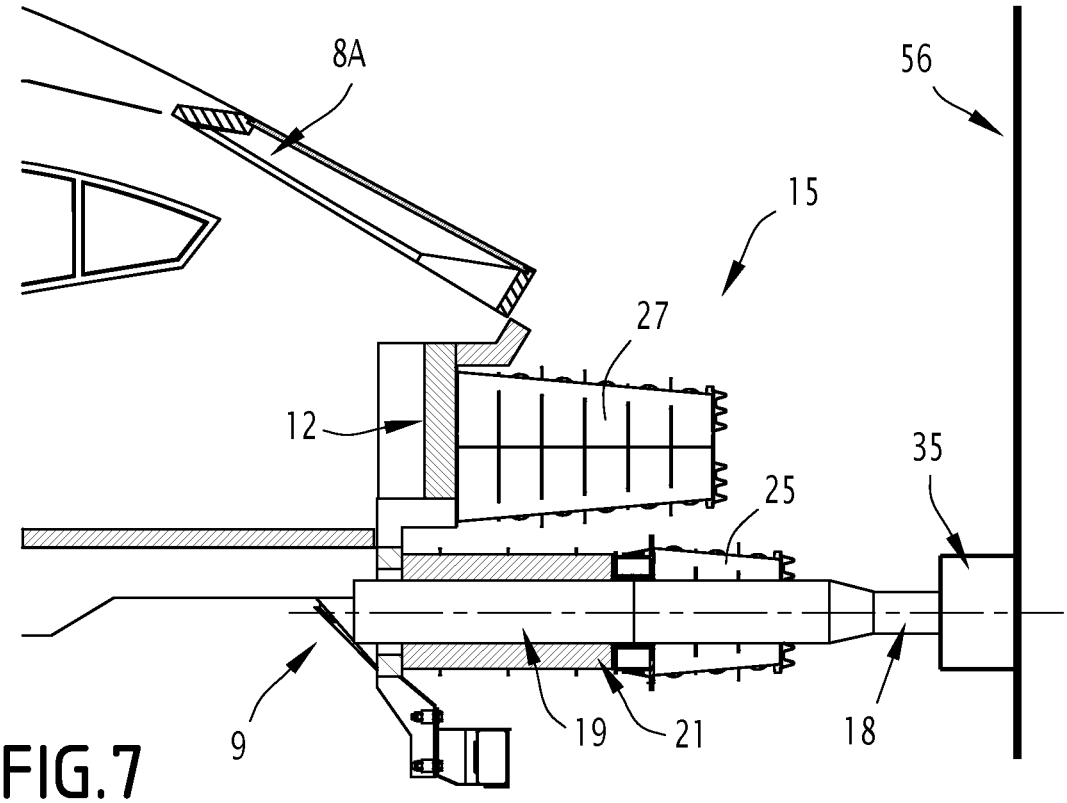

When the front of the power unit 8A, 8B collides with an obstacle 56 (FIG. 6), first of all the first energy absorbing system 15 begins to absorb the collision energy. Thus, the reversible energy absorber 37 of the automatic coupling 18 begins to absorb some of the collision energy. Beyond the reversible capacity of the coupling, the non-reversible energy absorber 39 of the coupling 18 is called upon and the deformation tube 19 begins to deform (FIG. 7).

Figure 8:
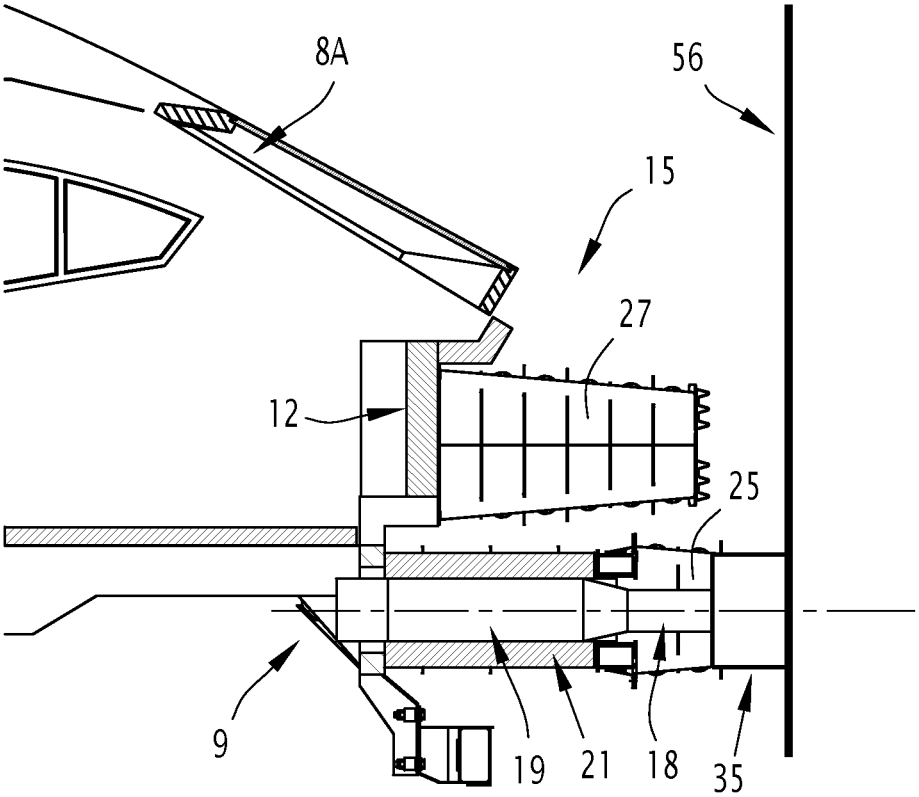

The lower deformation modules 25 (anti-overlapping) come into contact with the obstacle and begin to deform by being compressed longitudinally while the deformation tube 19 continues to deform (FIG. 8).

Figure 9:
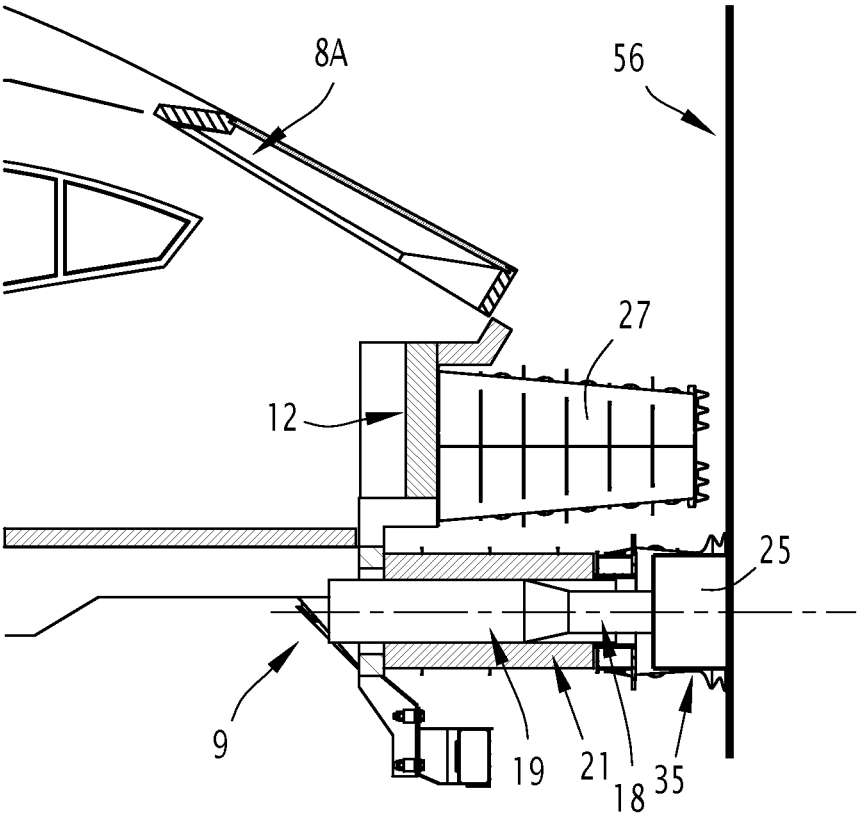

In the next step, the deformation tube 19 is deformed to the maximum and the compression of the lower deformation modules 25 is maximum. The fusible deformation modules 21 then begin to deform by being compressed longitudinally (FIG. 9).

Figure 10:
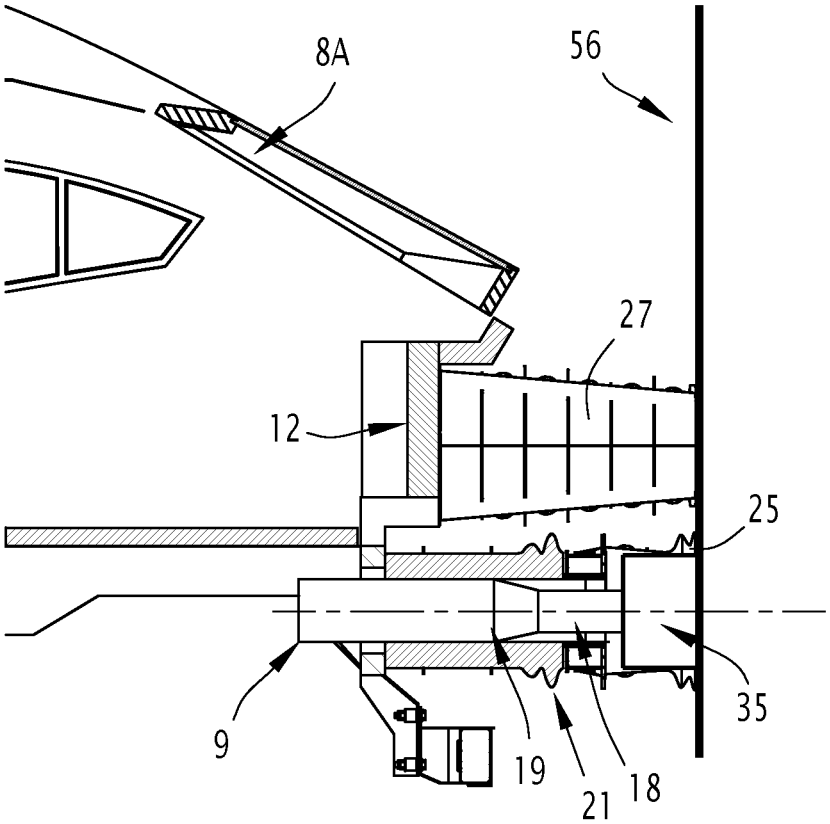

The upper deformation modules 27 then come into contact with the obstacle and begin to deform by being compressed longitudinally. The fusible deformation modules 21 continue to deform (FIG. 10).

Figure 11:
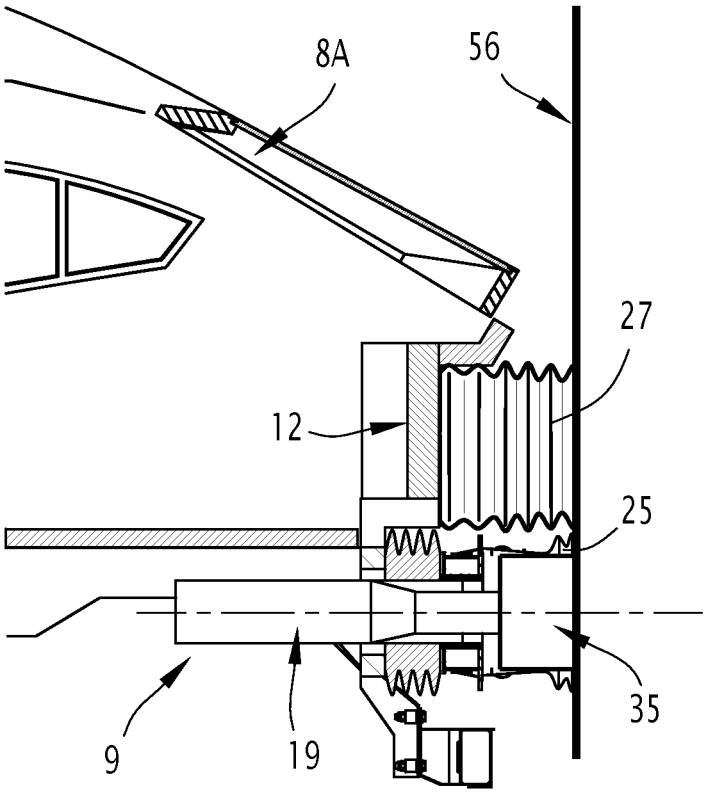
Figure 12:
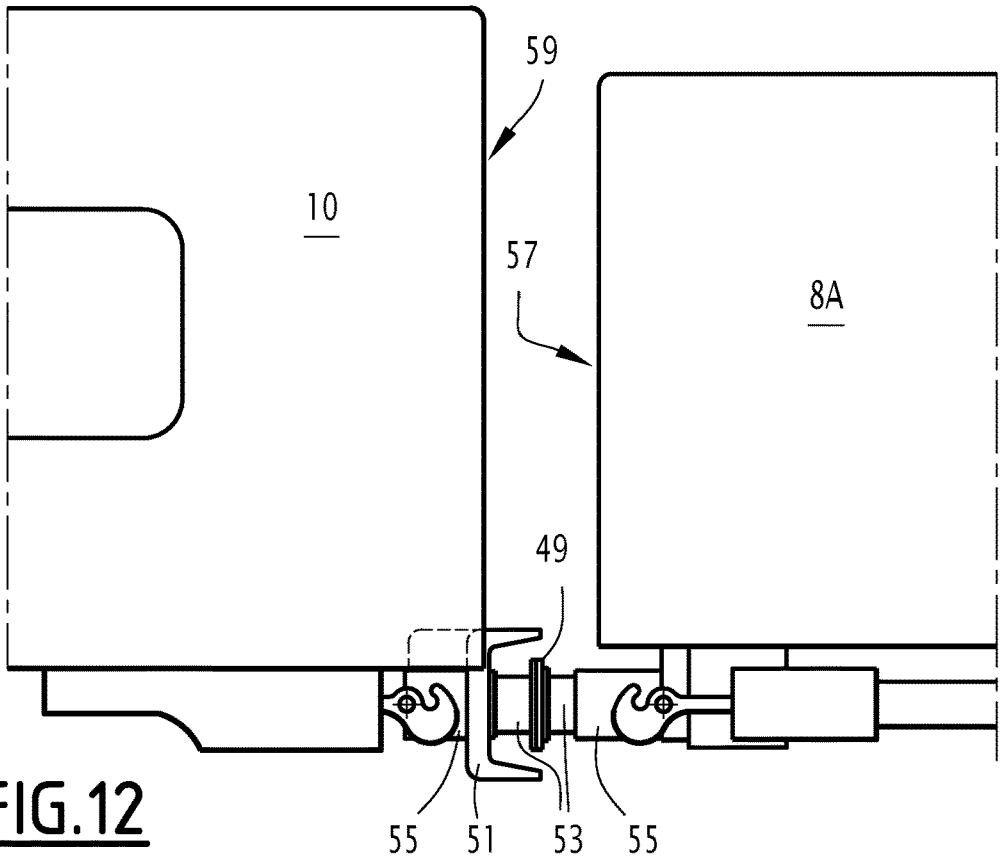
FIGS. 12 to 14 show schematic side views of the localized area at the link between the power unit and the first car showing the behavior of the second energy absorbing system at different stages of absorption of a frontal shock.
Figure 13:
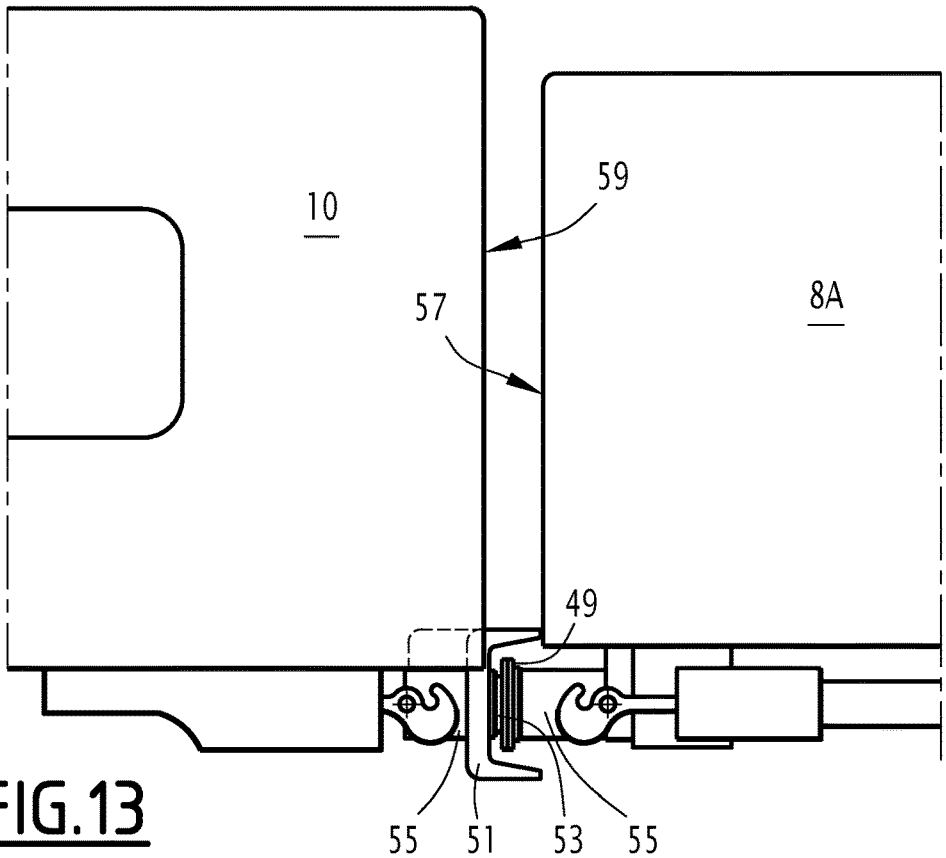

Finally, the fusible deformation modules 21 and the upper deformation modules 27 are compressed to the maximum (FIG. 11). The first energy absorbing system 15 has thus reached the maximum collision energy absorbing capacity. This capacity is between 3500 kJ and 7000 kJ, typically 5000 kJ.

Figure 14:
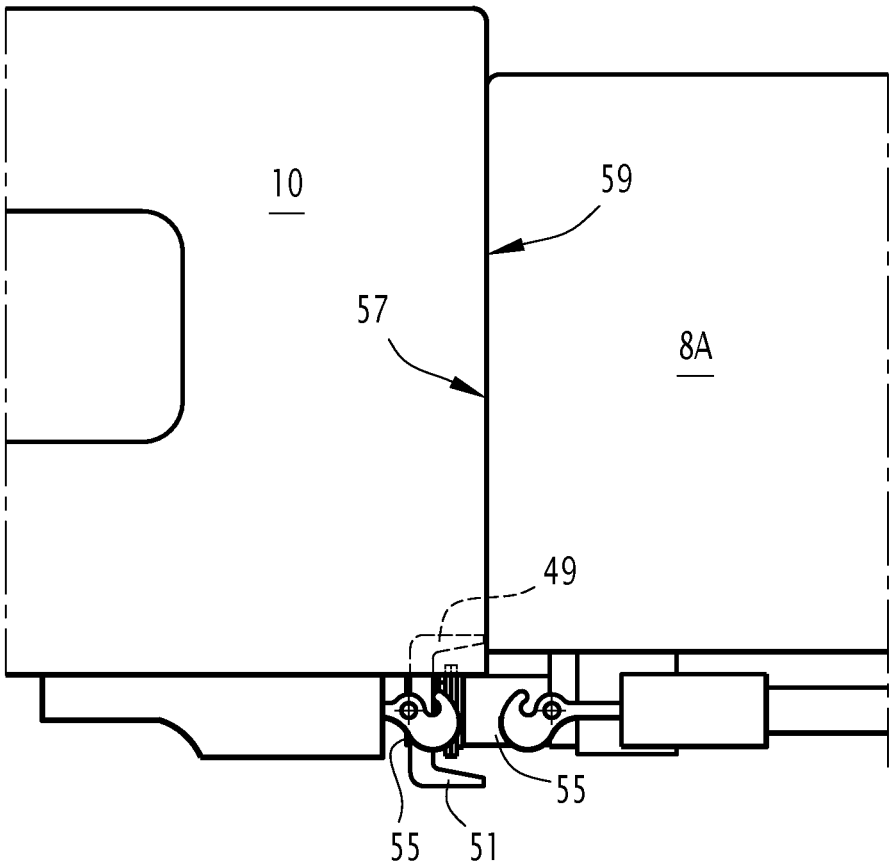

As soon as the impact between the power unit 8A, 8B and the obstacle 56 occurs, the second energy absorbing system 17 is also called upon. In a first step (FIG. 12), the impact causes a relative movement of the power unit 8A, 8B with respect to the first car 10, and the first reversible energy absorbing devices 53 of the buffers 43, 45 begin to absorb the collision energy. Then, the second non-reversible deformation energy absorbing devices 55 begin to deform (FIG. 13) until the maximum absorption capacity is reached and the rear side wall 57 of the power unit 8A, 8B contacts the front side wall 59 of the first car 10 (FIG. 14).

The second energy absorbing system has thus typically made it possible to absorb an amount of energy of between 1000 kJ and 4000 kJ, typically 2000 kJ.

Thus, the railway vehicle 1 according to the invention makes it possible to limit the rate of deceleration and to absorb all the energy of a collision. The integrity of the passengers and the driver is thus guaranteed. By the articulation between each adjacent car 3, the latter form a single mass and therefore the decelerations are homogeneous along the railway vehicle 1, and the passengers feel the same deceleration regardless of the car 3 in which they are located.

The invention is not limited to the example described. In particular, the energy absorbing systems are designed to suit the type of railway vehicle, the maximum authorized speed, or the weight of the railway vehicle and its distribution.

The invention claimed is:

1. A railway vehicle, comprising:

a plurality of cars placed one behind the other longitudinally, each car having a front end articulated to a rear end of the adjacent car;

at least one power car connected to a first of the cars; and a collision energy absorbing assembly, comprising a first collision energy absorbing system located at the front of the power car and a second collision energy absorbing system located at a link between the power car and the first car, wherein the railway vehicle further comprises a plurality of bogies, the front and rear ends of two adjacent cars being carried by one of the bogies, wherein the first collision energy absorbing system and second collision energy absorbing system being designed to absorb all the energy of a collision defined by the European standard EN 15227, wherein there is no collision energy absorbing system between two adjacent cars longitudinally behind the at least one power car and the first car.

2. The railway vehicle according to claim 1, wherein the first absorbing system comprises a plurality of deformation modules designed to deform in the longitudinal direction.

3. The railway vehicle according to claim 2, wherein at least one of the deformation modules is removable.

4. The railway vehicle according to claim 1, wherein the first absorbing system comprises an automatic energy absorbing coupling comprising an irreversible absorbing and coupling guiding system.

5. The railway vehicle according to claim 1, wherein the power car comprises a chassis, a driver's cab, and a protective shield fixed to the cab, the first absorbing system comprising two fusible deformation modules fixed to a front end of the chassis of the power car and connected by a crossbeam, two lower deformation modules fixed to the crossbeam, and two upper deformation modules fixed to the protective shield.

6. The railway vehicle according to claim 1, wherein the second absorbing system comprises two pairs of buffers fixed to a rear end of a chassis of the power car and to a front end of the first car.

7. The railway vehicle according to claim 6, wherein each buffer comprises a first reversible deformation energy absorbing device and a second non-reversible deformation energy absorbing device.

8. The railway vehicle according to claim 1, wherein the power car is connected to the first car by a drawbar, and the second energy absorbing system comprises a first reversible deformation energy absorbing device installed in the drawbar, a second non-reversible deformation energy absorbing device installed in the drawbar, and side absorbers on both sides of the drawbar.

9. The railway vehicle according to claim 1, wherein the at least one power car comprises a chassis and a driver's cab.

10. The railway vehicle according to claim 1, wherein at least one of the bogies being dedicated to the at least one power car and carrying only the at least one power car.

11. The railway vehicle according to claim 1, wherein the link between the at least one power car and the first car is articulated.

12. The railway vehicle according to claim 1 comprising two power cars placed at the two opposite ends of the railway vehicle.

13. The railway vehicle according to claim 12, wherein each power car comprises a collision energy absorbing assembly comprising a first collision energy absorbing system and a second collision energy absorbing system.

14. A railway vehicle, comprising:

a plurality of cars placed one behind the other longitudinally, each car having a front end articulated to a rear end of the adjacent car;

at least one power car connected to a first of the cars; and a collision energy absorbing assembly, comprising a first collision energy absorbing system located at the front of the power car and a second collision energy absorbing system located at the link between the power car and the first car, wherein the railway vehicle further comprises a plurality of bogies, the front and rear ends of two adjacent cars being carried by one of the bogies, wherein the first collision energy absorbing system and second collision energy absorbing system being designed to absorb all the energy of a collision defined by the European standard EN 15227, wherein the second absorbing system comprises two pairs of buffers fixed to a rear end of a chassis of the power car and to a front end of the first car.

15. A railway vehicle, comprising:

a plurality of cars placed one behind the other longitudinally, each car having a front end articulated to a rear end of the adjacent car;

at least one power car connected to a first of the cars; and a collision energy absorbing assembly, comprising a first collision energy absorbing system located at the front of the power car and a second collision energy absorbing system located at the link between the power car and the first car, wherein the railway vehicle further comprises a plurality of bogies, the front and rear ends of two adjacent cars being carried by one of the bogies, wherein the first collision energy absorbing system and second collision energy absorbing system being designed to absorb all the energy of a collision defined by the European standard EN 15227, wherein the power car is connected to the first car by a drawbar, and the second energy absorbing system comprises a first reversible deformation energy absorbing device installed in the drawbar, a second non-reversible deformation energy absorbing device installed in the drawbar, and side absorbers on both sides of the drawbar.

* * * * *